US006128871A

United States Patent [19]

Corey

[11] Patent Number: 6,128,871

[45] **Date of Patent: *Oct. 10, 2000**

[54] PIVOTABLE MUNTIN BAR CLIP

[75] Inventor: Harold Scott Corey, Live Oak, Calif.

[73] Assignee: Simonton Building Products, Inc., Pennsboro, W. Va.

[ * ] Notice: This patent issued on a continued prosecution application filed under 37 CFR 1.53(d), and is subject to the twenty year patent term provisions of 35 U.S.C. 154(a)(2).

[21] Appl. No.: 09/081,258

[22] Filed: May 19, 1998

[51] Int. Cl.[7] ..... E06B 3/68

[52] U.S. Cl. ..... 52/204.61; 52/314

[58] Field of Search ..... 52/314, 204.61, 52/456, 645; 16/387, 388, 391

[56] References Cited

U.S. PATENT DOCUMENTS

| | | | |
|---|---|---|---|
| 1,651,941 | 12/1927 | Ashkenas . | |
| 3,708,939 | 1/1973 | Herr . | |
| 4,723,388 | 2/1988 | Zieg . | |
| 4,838,001 | 6/1989 | Battles . | |
| 5,154,034 | 10/1992 | Stanek . | |
| 5,174,091 | 12/1992 | Stokx . | |
| 5,274,976 | 1/1994 | Burkhart . | |
| 5,456,048 | 10/1995 | White . | |
| 5,657,590 | 8/1997 | Digman et al. . | |
| 5,899,033 | 5/1999 | Merchlewitz | 52/204.61 |

*Primary Examiner*—Michael Safavi
*Attorney, Agent, or Firm*—Cesari and McKenna, LLP

[57] ABSTRACT

A muntin bar clip includes a contoured body that is shaped to contact the interior of top, bottom and opposing side walls of the muntin bar, and a head that is rotatably attached to the body. The end of the body to which the head is attached is narrowed, to accommodate the rotation of the head without drawing the body from the muntin bar. The body includes projections that extend upwardly and downwardly, and contact the top and bottom walls of the muntin bar. The head includes an L-shaped end, with an upwardly extending wall and a bottom wall. A downwardly extending extension connects to the bottom wall opposite the upwardly extending wall. The extension, which rotatably connects to the body, is separated from the upwardly extending wall by the width of the bottom wall, which is approximately one-half the width of a spacer. The upwardly extending wall is held between the spacer and a sheet of glass. The head holds the extension, and thus, the body and the muntin bar into which the body is installed, centered between the two sheets of glass that the spacer separates.

18 Claims, 3 Drawing Sheets

PIVOTABLE MUNTIN BAR CLIP

BACKGROUND OF THE INVENTION

Muntin bars, in a variety of arrangements, may be included in insulated glass windows. The muntin bars are attached to spacers that separate the two sheets of glass that form the window. It is critical that the bars do not come in contact with the glass, to avoid damaging the window.

Each muntin bar is typically held in place by one or more clips. The clip includes a body that is inserted into the bar, and a head that is fixedly attached to the body. The head contacts the spacer, to hold the bar in place.

Muntin bars may be arranged as grids in rectangular windows, with the clips holding vertical and horizontal bars at 90° with respect to the spacers. Alternatively, the clips may hold certain bars at 45° angles with respect to the spacers, to form a "diamond grid." Clips that hold the muntin bars at the 90° and 45° angles, respectively, are well known.

Muntin bars may also be installed in non-rectangular windows, for example, in semi-circular windows. In the non-rectangular windows, the bars must be held at various angles with respect to the spacers, ranging from near 0° to near 180°. The clips designed for use in the rectangular windows do not work well in the non-rectangular windows. For one reason, the clips do not hold the muntin bars at the required angles, in particular at angles between 45° and 90° or angles greater than 90°.

Elaborate systems have been developed to hold the bars at the angles required for the semi-circular windows and windows with various geometric shapes. Such systems include, for example, a bracket that holds one end of each of the multiple muntin bars at the desired angles. These systems are complex and are not readily adaptable to either different shapes of windows or different arrangements of the bars. Further, the systems are generally not aesthetically pleasing, and do not necessarily blend well with the systems used with nearby rectangular windows.

SUMMARY OF THE INVENTION

The invention is a muntin bar clip that includes a head that is rotatably attached to a body that fits inside the muntin bar. The head rotates to hold the muntin bar at any angle between essentially 0° and 180° relative to the spacer, and the body is constructed to center the bar between the two sheets of glass that form the window. The clip may be used with essentially any shape of insulated glass window and any arrangement of muntin bars.

The body of the muntin bar clip is as wide as the interior of the muntin bar and thus comes in contact with the side walls of the bar. The end of the body to which the head is attached is narrowed, to accommodate rotation of the head. The head can thus rotate essentially without drawing the body out of the muntin bar. The body supports is projections that extend upwardly and downwardly and contact the top and bottom walls of the bar. The projections center the body within the bar, and prevent the bar from pivoting relative to the body. Accordingly, positioning the head at a desired angle precisely positions the body, and thus the muntin bar, at the same angle with respect to the spacer.

The end of the head that contacts the spacer is L-shaped. A bottom wall supports at one side an upwardly extending wall that fits between the spacer and one of the sheets of the glass. The bottom wall supports at an opposite side an extension that extends downwardly and is rotatably attached to the body. The extension is separated from the upwardly extending wall, and thus, the glass that the wall contacts, by the width of the bottom wall. With the bottom wall approximately one-half as wide as the spacer, the head holds the body centered between the two sheets of glass. The body, in turn, centers the muntin bar between the two sheets of glass. The muntin bar therefore does not come into contact with the glass, regardless of the angle between the head and the body of the clip.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
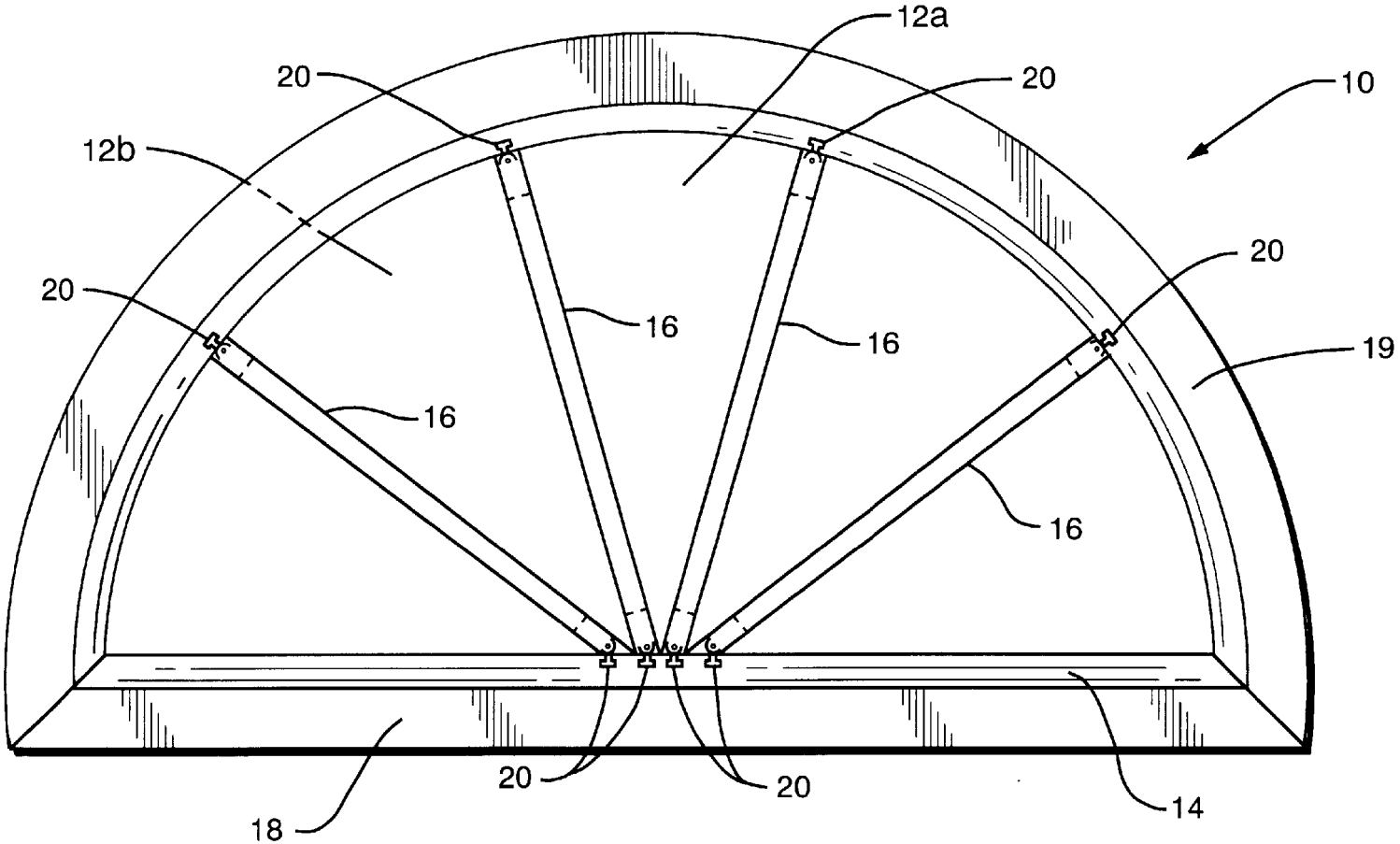
FIG. 1 depicts a semi-circular window that includes muntin bars held in place by clips that are constructed in accordance with the invention.

Referring now to FIG. 1 a semi-circular insulated glass window 10 includes two sheets of glass 12*a* and 12*b* that are separated by spacers 14 that extend around the periphery of the window. Muntin bars 16 extend between the spacer that runs along a horizontal component 18 of the window 10 and the spacer that runs along a rounded component 19 of the window 10. The muntin bars 16 are hollow and clips 20, which are depicted in dotted lines and are discussed in more detail with reference to FIGS. 2 and 3 below, fit into and hold the muntin bars 16 at their respective angles relative to the spacers 14.

Figure 2A:
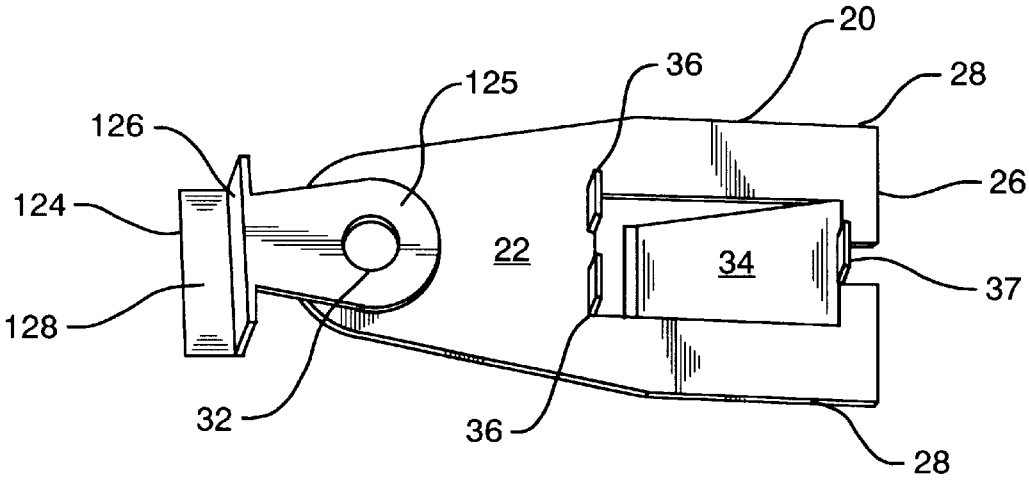
FIGS. 2A and 2B are, respectively, top and bottom isometric views of the clip.
Figure 2B:
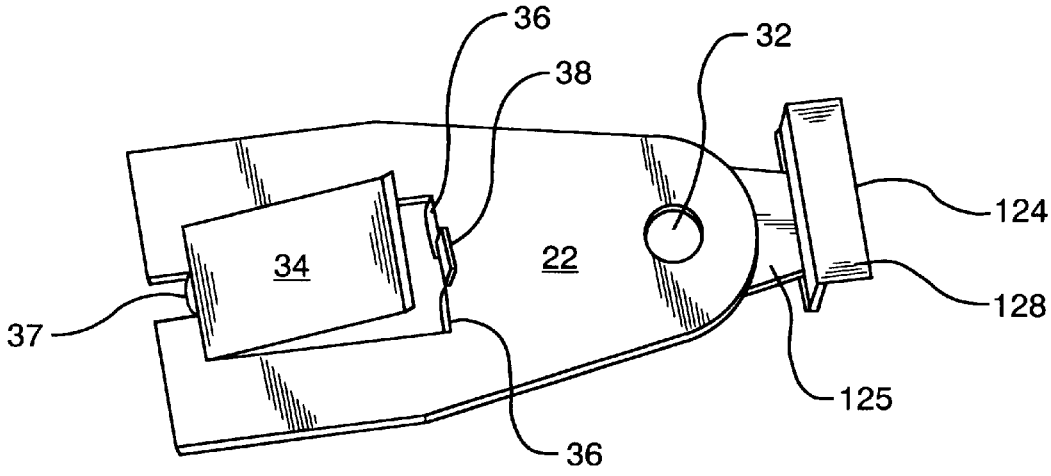
Figure 3:
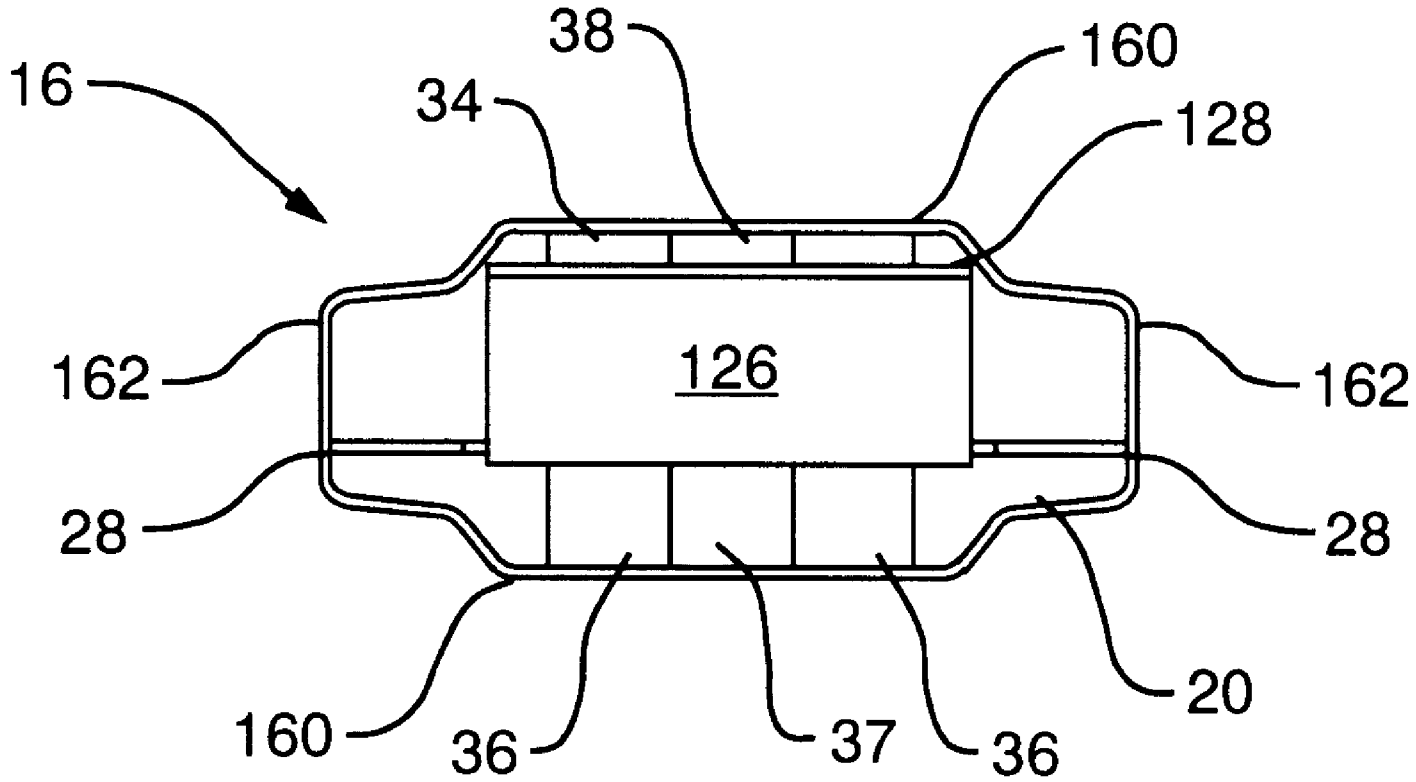
FIG. 3 is an end view of the clip and muntin bar.

Referring now to FIGS. 2 and 3, the clip 20 includes a contoured body 22 and a rotatably attached head 24. The body 22 of the clip is sized to fit inside an end of the muntin bar 16. A first end 26 of the body 22 is sufficiently wide that edges 28 of the body contact the interior surfaces of the side walls 162 of the muntin bar 16. The body 22 is narrowed at its second end 30, to allow the head 24 to rotate about a pivot 32 without drawing the body out of the bar. The head can rotate over a range of approximately 0° to 180°, where 0° is perpendicular to a longitudinal axis of the body 22, although the body is drawn slightly from the clip at either end of the range. A plurality of projections 36–38 extend, respectively, from top and bottom surfaces of the body. The projections 36–38 are sufficiently long to contact the interior surfaces of the top and bottom walls 160 of the muntin bar. Accordingly, the sides 28 and projections 36–38 touch all four walls of the muntin bar, to hold the body at a predetermined position within the bar. In the embodiment depicted in FIG. 3, the body is centered within the bar.

A pivotable tab 34 that is cut out of the body 22 on three sides also rests against the bottom wall 160 of the muntin bar. The pivotable tab acts essentially as a spring, to hold the clip within the bar. The projections 36 and 38 are formed by cutting perpendicular slots into the body at the opening left by the tab, and bending the cut edges of the body upwardly or downwardly, as appropriate. Similarly, the end 26 of the body is cut and bent to form the projection 37.

The head 24 includes an L-shaped end 124 and an extension 125. The L-shaped end 124 contacts the spacer 14 (FIG. 1), while the extension 125 rotatably connects to the body 22 at the pivot 32.

The L-shaped end 124 of the head 24 includes a bottom wall 126 that connects at one side to the extension 125 and at an opposite side to an upwardly extending wall 128 that is perpendicular to the bottom wall. The upwardly extending wall 128 fits between the spacer 14 and one of the sheets of glass 12*a* or 12*b*. The bottom 126 wall is approximately one-half the width of the spacer 14. Accordingly, the extension 125, the body 22, and thus, the muntin bar 16 are centered between the two sheets of glass 12*a* and 12*b* (FIG. 1). The head 24 rotates about pivot 32 without pivoting or rotating the body 22. Further, the sides 28 and projections 36–38 of the body prevent the muntin bar from rotating or pivoting about the body. The clip thus holds the muntin bar centered between the glass, regardless of the 0° to 180° angle of the head relative to the body.

In the embodiment depicted in FIGS. 2*a* and 2*b*, the body 22, and the head 24 are formed, respectively, from single pieces of aluminum that are appropriately bent to form the walls and projections.

The muntin bar clips depicted in the drawings are easily and relatively inexpensively manufactured. The body 22 is one-piece, with the projections 36–38 and the tab 34 formed by appropriate cutting and bending. The head 24 is also one-piece, with the L-shaped end 124 formed by appropriate bending. The clips may be used with any shaped windows and with any arrangement of the muntin bars. Accordingly, a window manufacturer need stock only these clips, rather than elaborate systems designed for use with particular shapes of non-rectangular windows and particular arrangements of the muntin bars. The clips are aesthetically pleasing when in place, and are essentially hidden from view. The shaped windows thus match nearby rectangular windows that use the conventional clips, which are also hidden from view.

The foregoing description has been limited to a specific embodiment of this invention. It will be apparent, however, that variations and modifications may be made to the invention, such as including more or fewer projections on the body, constructing the body and/or head out of multiple pieces, or various materials, restricting the head to a range of rotation that is somewhat smaller that 0° to 180° and so forth, with the attainment of some or all of its advantages. Therefore, it is the object of the appended claims to cover all such variations and modifications as come within the true spirit and scope of the invention.

What is claimed is:

1. A muntin bar clip, adapted for pivotally securing a muntin bar to a window assembly, the clip including:

A. a contoured body that has a first end and a second end, with the second end being narrower than the first end and with the first end being adapted for insertion into a muntin bar; and B. a head, adapted for securing the clip to a window assembly, the head being rotatably attached to the second end of the body and including:

i. an upwardly extending wall for contacting a spacer of the window assembly;

ii. a downwardly extending extension that connects to the body; and iii. a bottom wall to which the upwardly extending wall and the downwardly extending extension are attached, the upwardly extending wall being separated from the downwardly extending extension by the width of the bottom wall wherein the head rotates relative to the body to position the muntin bar at a desired angle relative to the window assembly.

2. The clip of claim 1 wherein the head rotates over a range of approximately 0° to 180°, with 0° being perpendicular to a longitudinal axis of the body.

3. The clip of claim 2 wherein the bottom wall of the head has a width that is approximately one-half the width of the spacer.

4. The clip of claim 1 wherein the body includes a top surface, a bottom surface and projections that extend upwardly from the top surface and downwardly from the bottom surface, wherein the projections are sized and arranged for securing the body within a muntin bar.

5. The clip of claim 1 wherein the width of the body is sized and arranged for securing the body within a muntin bar.

6. The clip of claim 1 wherein the bottom wall is sized and arranged to center the muntin bar within the window assembly.

7. A muntin bar clip, adapted for pivotally securing a muntin bar to a window assembly, the muntin bar clip including:

A. a contoured body, the body comprising a first end, wherein the first end is sized and arranged for securing the body within a muntin bar and a second end that is narrowed, the body further including projections that extend upwardly and downwardly from the body, wherein the projections are sized and arranged for securing the body within a muntin bar; and B. a head, adapted for securing the muntin bar clip to the window assembly, the head being rotatably attached to the second end of the body such that the head rotates relative to the body to position the muntin bar at a desired angle relative to the window assembly.

8. The clip of claim 7 wherein the head includes an upwardly extending wall that contacts a spacer, a downwardly extending extension that connects rotatably to the body and a bottom wall that connects to the upwardly extending wall and the extension, the upwardly extending wall and the extension being separated by the width of the bottom wall.

9. The clip of claim 8 wherein the bottom wall of the head has a width that is approximately one-half the width of the spacer.

10. The clip of claim 7 wherein the head rotates over a range of approximately 0° to 180°, with 0° being perpendicular to a longitudinal axis of the body.

11. The clip of claim 8 wherein the bottom wall is sized and arranged to center the muntin bar within the window assembly.

12. A muntin bar clip, adapted for pivotally securing a muntin bar to a window assembly, the muntin bar clip including:

A. a contoured body, the body including a first end that is narrower than a second end, wherein the second end is sized and arranged for securing the body within a muntin bar; and B. a head, adapted for securing the muntin bar clip to a window assembly, the head being rotatably attached to the first end of the body, wherein the head rotates relative to the body to position the muntin bar at a desired angle relative to the window assembly.

13. The clip of claim 12 wherein the head rotates over a range of approximately 0° to 180°, with 0° being perpendicular to a longitudinal axis of the body.

14. The clip of claim 12 wherein the head includes an upwardly extending wall that contacts a spacer, a downwardly extending extension that connects rotatably to the body and a bottom wall that connects to the upwardly extending wall and the extension, the upwardly extending wall and the extension being separated by the width of the bottom wall.

15. The clip of claim 14 wherein the bottom wall of the head has a width that is approximately one-half the width of the spacer.

16. The clip of claim 12 wherein the body includes a top surface, a bottom surface and projections that extend upwardly from the top surface and downwardly from the bottom surface, the projections being sized and arranged for securing the clip within a muntin bar.

17. The clip of claim 16 wherein the width of the body is sized and arranged for securing the body within a muntin bar.

18. The clip of claim 14 wherein the bottom wall is sized and arranged to center the muntin bar within the window assembly.

* * * * *